United States Patent [19]

Lapierre

[11] 4,318,455

[45] Mar. 9, 1982

[54] FAST-WINDING SPRING MOTOR

[76] Inventor: Philippe Lapierre, 4, rue Pauly, 75014 Paris, France

[21] Appl. No.: 29,756

[22] Filed: Apr. 12, 1979

[30] Foreign Application Priority Data

Apr. 14, 1978 [FR] France ..... 78 11064

[51] Int. Cl.[3] ..... F03G 1/04; F03G 1/08

[52] U.S. Cl. ..... 185/39; 46/78; 185/DIG. 1

[58] Field of Search ..... 185/38, 39, DIG. 1; 46/78

[56] References Cited

U.S. PATENT DOCUMENTS 1,366,164 1/1921 Cornish ..... 46/78

2,254,767 9/1941 Bardwell et al. ..... 46/78

FOREIGN PATENT DOCUMENTS 2359701 11/1973 Fed. Rep. of Germany ..... 46/78

2351278 5/1976 France ..... 185/DIG. 1

*Primary Examiner*—Allan D. Herrmann

*Attorney, Agent, or Firm*—Lewis H. Eslinger

[57] ABSTRACT

Spring motor for toy vehicles mainly comprising a spring constituted by a twisting rubber skein driving a driving-shaft connected to the propeller by a gear transmission and carrying a maneuvering endpiece receiving a winding crank which crosses the circle swept by the propeller. A free wheel may be included in the gear transmission.

8 Claims, 14 Drawing Figures

FAST-WINDING SPRING MOTOR

The present invention relates to a spring driven motor, or similar energy accumulator suitable for toys with a driving member and, in particular, for propeller planes commonly known as rubber powered planes.

Many designs of this type are known, the simplest ones being constituted of a rubber skein placed longitudinally in the fuselage of the model, the rear end of which being fixed and integral with the fuselage, whilst the front end is fast in rotation with the propeller.

Studies for longer flights have resulted in numerous mechanical devices using several skeins placed in parallel or end to end with mechanical countershaft, or else undwinding successively. Then, some simpler and more practical devices appeared comprising a step-up gear connecting one large skein to the propeller.

Also, studies for a quicker winding of the skein than the mere reverse swinging of the propeller have resulted in many mechanical devices. Some of these are only used for winding and can often increase cost prices prohibitively. Moreover, if they are fitted on board the model plane, they also constitute a dead weight which penalizes flight performances. Rear winding devices, needing to be balanced by a heavy counter-weight at the front, have the same disadvantage. Finally, a number of devices include a double transmission between the skein and the propeller, one for winding, the other for unwinding. The transmission selection is either automatic, by means of pawls, or manual, by axial movement of the propeller for example. The winding is itself effected by turning the propeller with the finger. These mechanisms are complex, often fragile, and only give poor gear-ratios. Beyond a certain gear-ratio, the winding torque would indeed require a substantially reinforced and heavier propeller, and would damage the operator's finger.

Finally, none of these mechanisms has really satisfactorily overcome the double disadvantage of the rubber motor: limited flight time and tedious winding, whilst retaining its qualities: low prices and simplicity.

It is the object of the invention to propose a device which on the contrary solves completely the problems of flight time and of winding, using very simple means. This device consequently constitutes a perfect propelling assembly for toy planes and small flying scale models, for which the flight qualities, the easy use and the minimum costs should be reconciled.

It is an original adaptation of multiplying gear trains—the advantages of which as far as flight time and regularity are concerned, are known—permitting the fast and unassisted winding of the motor, with the minimum of complexity and of extra weights.

The device according to the invention consists essentially in an accumulator spring one end of which is fixed, whilst the other is fast with a driving-shaft. Said driving shaft is connected to the shaft carrying the propeller by means of a gear transmission and also carries a manoeuvring endpiece on which a removable winding member can be fitted rigidly enough so as to be operated with one hand only.

The direct winding of the driving skein is possible by simple operation of the winding member. Each turn of the crank entails a turn of the skein, which latter restitutes several turns of the propeller due to the gear transmission. The winding is thus as fast as with a winding gear member, attacking the propeller, but easier yet, and it only requires a crank in addition to the gear member fitted in to increase the flight time.

The crank being located at the front of the propeller plane, it is easy and quick to operate, with very natural movements. The direct connection between the skein and the hand of the operator allows the latter to really feel the reactions of the skein during winding and to acquire rapidly the experience he needs to limit the winding to a safe value, without having to count the stored spins. The advantage of a single skein is that it is extremely easy to fit, and of minimum weight, since there is only one hook at the front and at the rear, and no connecting system between skeins. The possibility of adopting large gear ratios, near to twelve, allows the use of very thick and short skeins, leaving the rear of the fuselage free, and thereby simplifying considerably the problem of the centering of the model plane. Increased flight time, speeded up winding, restriction of the fitted-in mechanism strictly to those of its members used for flying, concentration of the weight at the front, all these qualities contribute to produce a mechanism which is particularly adapted to the propulsion of model planes.

In a first example of embodiment of the device according to the invention, the removable winding member crosses the field swept by the propeller outside its axis and thus prevents the rotation of the propeller when said latter is positioned on the end of the driving-shaft. The kinematic chain connecting the driving-shaft to the propeller comprises in this case at least one device of disengagement allowing the winding of the motor by a reversed movement, despite the immobilization of the propeller. The advantage of this first arrangement is to lock the unwinding when the winding member is fitted in.

In a second example of embodiment of the device according to the invention, the propeller and the driving shaft are co-axial, the latter being able to cross right through the propeller and to be fitted with a winding endpiece in front of the circle swept by the propeller. Thus, the fitting of the winding member does not necessarily require the propeller to be immobilized, and said latter can easily be spun quickly in reverse by the gear train throughout the whole winding operation.

The working of the device according to the invention will be better understood with reference to the accompanying drawings in which.

Figure 1:
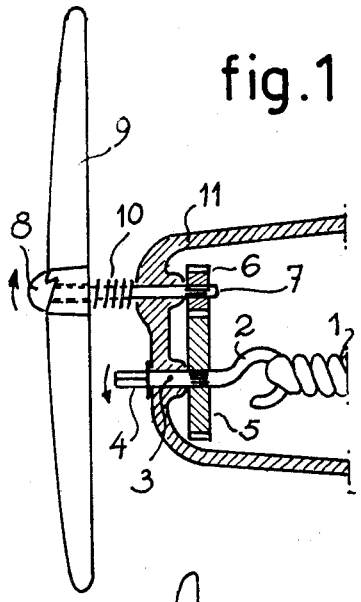
FIG. 1 shows a simple embodiment of the device according to the invention during the motive unwinding phase.

In FIG. 1, the rubber skein 1 drives the end 2 of the driving-shaft 3 in rotation, said latter having another end 4 shaped as an operation plug square. A gear 5, fast with the shaft 3, engages and drives in rotation another gear 6 substantially smaller than the first.

The gear 6 is fast with its axis 7 which it carries in its rotation, as well as the endpiece 8 which has the shape of a pawl fitting into a complementary pawl carried by the propeller 9, held in contact with 8 by a spring 10. Axes 3 and 7 turn freely in the bearings of the casing 11.

The driving movement of the skein 1 is thus multiplied by the gear train and transmitted to the propeller by the pawl 8 until the unwinding is over. Then, the propeller can go on with its idle spinning whilst getting free of the pawl 8 after having compressed the spring 10.

Figure 2:
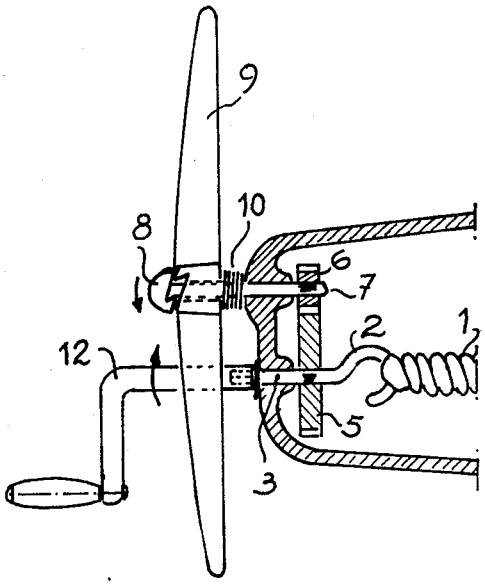
FIG. 2 shows the same embodiment during the winding phase.

In FIG. 2, a winding handle 12 has been introduced on the end of the shaft 3, thereby allowing the direct winding of the rubber skein by a retrograde rotation (in the direction of the arrow). This retrograde is also transmitted via the gears and the axis 7 to the pawl 8, which drives the propeller in backward rotation, until one blade comes in abutment on the crank 12. The pawl 8 then pushes back the propeller 9 which compresses the spring 10 and thus releases the pawl 8, the latter being then able to go on turning at the rythm imparted by the crank through the gear train, the propeller being itself immobile until the winding is completed.

When the stress applied on the crank 12 stops, the wound up accumulator spring 1 drives it in the unwinding direction (reverse to the arrow). The propeller 9, re-engaged into the pawl 8 effects an incomplete rotation until another blade comes in turn into abutment on the crank 12, thereby locking the whole device and making it possible to let go the wound up motor without any risk of unwinding. The unwinding will only occur when the crank is released from the shaft 3 and brought out of the field swept by the propeller.

In this first example of embodiment, the different elements constituting the device may be produced differently, without for all that departing from the scope of the invention.

Figure 3:
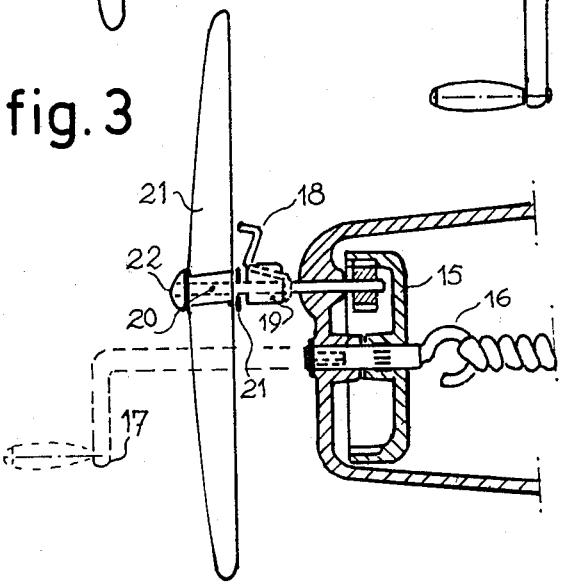

FIG. 3 shows, by way of example, another embodiment wherein all the constituting members are produced differently. In particular, there is shown a gear 15 fast with the driving-shaft 16, produced here as an inside gear which reduces the overall dimensions of the device.

The winding crank 17 fits into the driving shaft 16, which has the advantage of totally concealing the said driving-shaft.

The free wheel on the propeller-shaft is produced in a particularly simple and inexpensive manner, in the form of a hook 18 mounted to pivot about an oblique axis in a bearing 19 integral with the propeller-shaft 20. The propeller 21 is mounted for free rotation on the shaft 20, its longitudinal clearance being limited by a cross-piece 21 and a removable stop means 22 in order to allow the replacement of the propeller whenever necessary. Said stop means 22 may be for example a rubber propeller cone, forcibly fitting onto the shaft 20.

The rotation of the hook 18 is limited by its two elbow ends, coming into contact with abutments provided on the bearing 19, or simply as shown here on the shaft 20.

Figure 4:
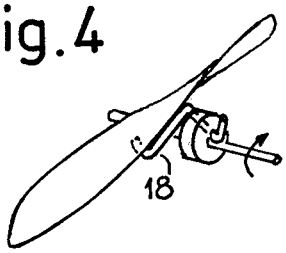

FIG. 4 shows the propeller-shaft and its free wheel in the engaged position during the driving unwinding.

Figure 5:
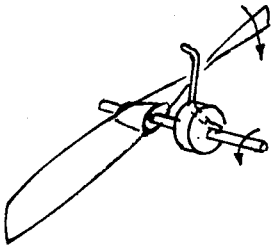

FIG. 5 shows the same device in the winding phase or in the propeller idle spinning phase at end of flight, the hook 18 being tilted towards the right and towards the rear and consequently leaving the area swept by the propeller, the latter being left to rotate freely.

The oblique axis of rotation of the hook 18 can, but need not be, in the same plane as the propeller-shaft.

It will be noted that at the start of the driving phase, when the propeller-shaft starts rotating in the direction of the arrow (in continuous line on FIG. 6) it carries with it, the hook 18 due to inertia, in a relative rotation to the left (arrow in dotted line). The inclination of the pivoting axis causes a relative movement of its end 25 towards the front, which end comes in hooking engagement with a propeller blade before 20 has made a complete rotation.

The advantage of the free wheel device which is described is to permit the fitting of standard propellers, with no special driving device, and to allow a perfectly free rotation of the propeller on its axis at the end of the unwinding operation, during free flight of the model plane.

Figure 7:
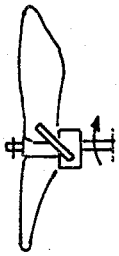

Another example of embodiment of this free wheel with an axis perpendicular to the propeller-shaft is shown in FIG. 7.

Figure 8:
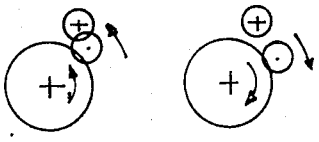

Other embodiments are of course possible without departing from the scope of the invention, such as for example, multiplying gear trains with more than two gears, ratchet wheels fitted in the gears, or in the form of a gear moving laterally (FIG. 8).

Figure 9:
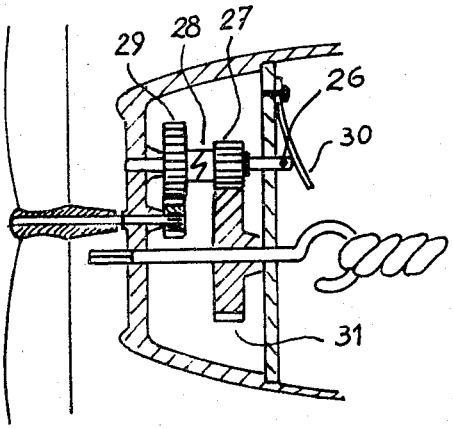

FIG. 9 thus shows another example of embodiment wherein it is possible with a four-gear train to obtain a greater gear ratio and consequently a much longer flight.

The free wheel in this case is produced in the simple form of an intermediate axis 26 which is fast, at least in translation, with a pinion 27 bearing against one face of teeth 28 and adapted to drive the pinion 29 only in the unwinding direction. The pinion 29 is floatingly mounted on the axis 26 which can move back, but is brought back towards the front by a spring 30. During winding, the pinion 29 can remain stationary with the propeller, whereas the pinion 27 is driven in rotation by the driving pinion 31, and therefore moves back due to the inclined flanks of the teeth 28, by compressing the spring 30. During the unwinding phase, the spring 30 returns the axis 26 and the pinion 27 towards the front, and the teeth 28 restore the connection with the pinion 29. At the end of the unwinding phase, the propeller can go on spinning out of gear as shown in the previous examples.

Other embodiments of free wheels are possible, but the aim towards a minimum weight, rather favors a location where the torque transmitted is low, namely on the propeller-shaft as shown in FIG. 1, or even on the intermediate axis as in FIG. 9. In the same way, the improvement of free-flight by a very free rotation of the propeller under the effect of relative wind, will favor the same locations which limit the members driven by the propeller, and it will also favor free wheels with low friction.

Figure 10:
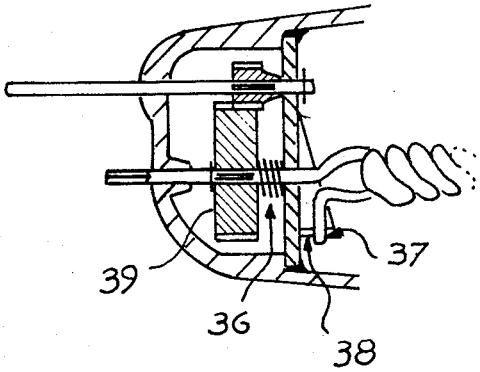

FIG. 10 shows another variant of the device, wherein a spring 36 opposing the tension of the skein pulls the driving shaft towards the front before the unwinding is completely over. A locking device is provided in that fore position, for example in the shape of a finger 37 on the driving-shaft, which comes into position on an abutment 38. Said abutment 38 has a slightly inclined back to allow the free rotation in the winding direction. It is possible with this special arrangement to use skeins whose length is substantially greater than the distance separating the front and rear hooks, and to that extent to increase the flight duration. In every case, it is also possible with the said arrangement, and even after a remanent lengthening caused by intensive use, to retain a minimum pulling force of the skein on the mechanism, which is very useful when the latter is removable and runs the risk, without that precaution, of getting disconnected when the driving phase is over. Finally the said arrangement prevents starting the winding in the wrong direction. This prevention is all the more useful that it spares the free wheel the excessive torques that it would be subject to during this wrong manoeuvre, whenever the disposition of the winding crank prevents the free rotation of the propeller (which is the case in FIGS. 2, 3 and 12 for example.)

The arrangement shown in FIG. 10 is not restrictive, and other embodiments of the motor stopping device are possible without departing from the scope of the invention. For example, the abutment may be integral with the front wall of the mechanism, and a helical rack may be provided opposite the said abutment in the front face of the driving pinion 39.

Figure 11:
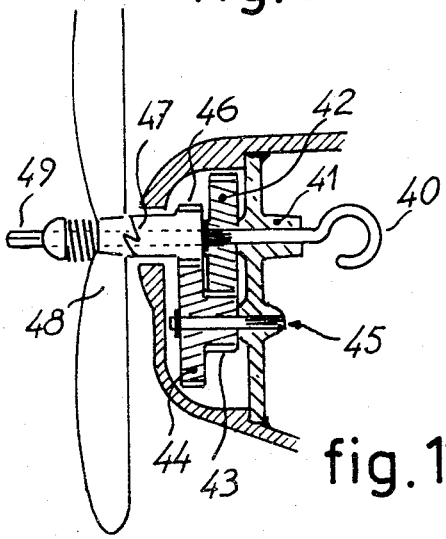

FIG. 11 shows another example of embodiment of the device according to the invention, wherein the propeller and the driving-shaft are co-axial.

The gear 42 is fast with the driving-shaft 40 which rotates freely in the bearing 41 of the casing. The gear 42 engages the small pinion 43, which is integral with the large pinion 44, both of these rotating freely on the stationary axis 45. The pinion 44 engages the small pinion 46 which rotates freely on the driving shaft 40 and carries the propeller 48, for example by the ratchet device 47 or any other device with or without a free wheel.

The end 49 of the driving-shaft is designed to receive the winding member.

In this specific case, the presence of a pawl is not absolutely necessary, since the winding can be effected with simultaneous fast driving of the propeller.

Figure 6:
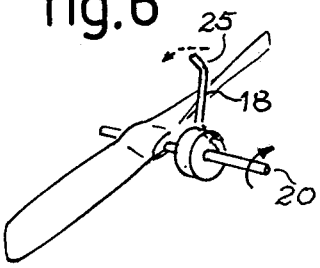
Figure 12:
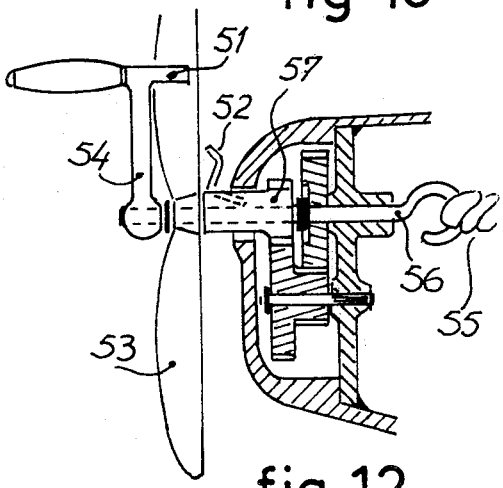

FIG. 12 shows an interesting variant of the preceding embodiment, wherein the winding member is provided with an element 51 which penetrates inside the circle swept by the propeller and prevents its free rotation with respect thereto. The kinematic chain connecting the driving-shaft to the propeller 53 comprises a free wheel, for example in the shape of the pivotally mounted hook 52 as already described hereinabove, (FIGS. 4 to 6).

During the winding phase, the movement of the crank 54 is transmitted first to the rubber skein 55 via the driving-shaft 56 and then, to the propeller 53 via the finger 51. The speed difference between the gear 57 (driven quickly in reverse by the gear train) and the propeller driven more slowly in the same direction by the finger 51, is absorbed by the free wheel 52.

Immediately the winding force is cancelled, the motor then drives back, in the other direction of the crank, the finger 51, the gear 57 and the pawl 52 which, as mentioned hereinabove, hooks up a propeller blade and the whole assembly is quickly locked, the free wheel being unable, in the unwinding direction, to absorb the difference in rotation speed between 57 and 53, locked in position by the finger 51.

And thus, in this case, the self-locking of the wound up motor is obtained.

Figure 13:
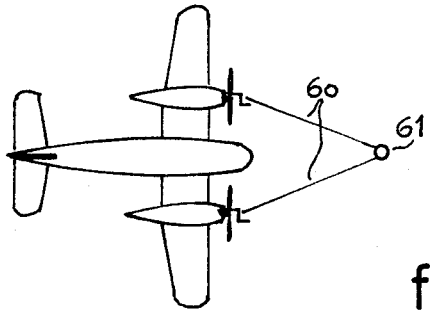

Each time a self-locking is obtained when the winding is over (case of the devices shown in FIGS. 2, 3 and 12), this can be turned to advantage to allow the successive winding of several motors in a multiple-motor model, such as that shown in FIG. 13. The different winding members can advantageously be connected by strings 60 to a handle or ring 61, permitting a simultaneous extraction just before releasing the model.

Figure 14:
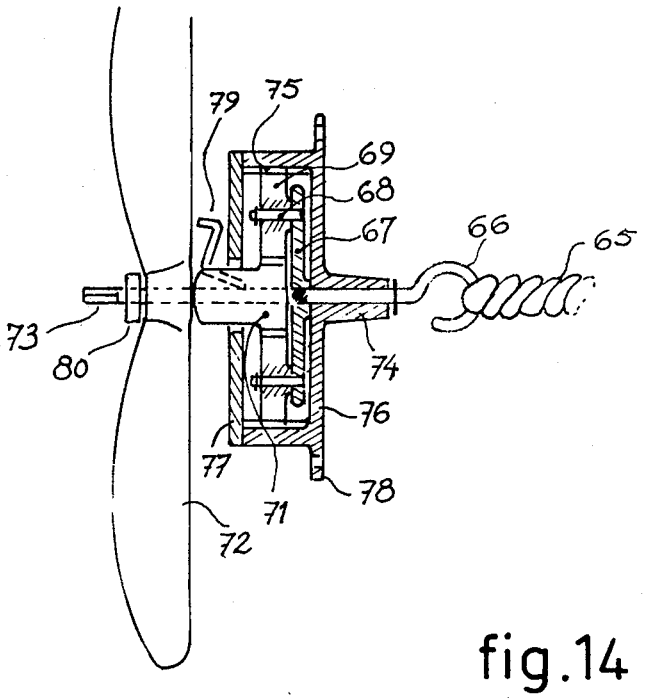

FIG. 14 shows another example of embodiment of the device according to the invention, using a step-up gear with planetary gear train giving a particularly simple and compact assembly.

The driving skein 65 drives the driving-shaft 66, rotating in the bearing 74 of a casing 76 provided with inside teeth 75.

A plate 67 integral with the shaft 66 carries axes 68 on which the gears 69 pivot, engaging on the one hand with 75 and on the other hand with a small pinion 71 pivoting freely on the driving shaft 66.

The pinion 71 comprises elements adapted to drive the propeller 72 in rotation, which propeller also rotates freely on the drivng shaft 66, for example as an out-of-gear hook 79, such as described hereinabove. A stop device 80 holds the propeller in position on the driving-shaft 66, which shaft is provided with a driving end-piece 73 meant to receive a winding crank.

In the accompanying figures, the driving shaft receiving the rubber skein is shown to have a C-shaped end. Said end can also have other known forms appropriate to receiving a skein. T or S shapes are for example very suitable for skeins of large section as they eliminate their tendency to rise along the hook under the effect of twisting.

Moreover, in the description given hereinabove, it is mainly referred to a device adapted to a pulling propeller situated at the front of a model plane, but it is obvious that the device can be used for setting into motion a propulsing propeller situated at the rear, or any other pivoting element in a toy or a scale model, in the same way as the rubber spring may be replaced by any other already known spring, without for all that departing from the scope of the invention.

What is claimed is:

1. A spring motor for toy plane or vehicle with propeller, comprising an energy-storing device constituted by a rubber skein or the like, comprising a driving-shaft situated in extension of the skein and moved by said latter, connected to the propeller by a gear transmission, wherein a device for directly winding the driving skein is provided through the circle swept by the propeller, in the form of a crank or similar type, which can be fitted on the end of the driving-shaft.

2. A device as claimed in claim 1 wherein the crank which is fitted on the end of the driving-shaft for winding purposes, crosses the circle swept by the propeller outside its centre, thereby preventing the free rotation of the propeller during and at end of winding, and wherein a free wheel device is placed on the kinematic chain connecting the driving-shaft to the propeller, which device can interrupt the said kinematic chain during the reverse movement of winding and restore it in the unwinding direction.

3. A device as claimed in claim 1 wherein the propeller and the driving-shaft are co-axial, said latter crossing the propeller in its centre, its end which receives the winding crank being situated in or in front of the propeller plane.

4. A device as claimed in claim 3 wherein the winding crank of the driving-shaft further comprises a propeller driving finger, and wherein a free wheel device is placed on the kinematic chain connecting the driving-shaft to the propeller, which device can interrupt the said kinematic chain during the reverse winding movement, and restore it in the unwinding direction.

5. A device as claimed in any one of claims 1 to 4 wherein the driving-shaft can also move towards the front, under the action of a spring, when the unwinding of the skein comes to an end and its tension reduces, such movement causing the interference of an element pivoting with the driving-shaft and of a stationary element, in order to stop the unwinding of the skein before its tension is cancelled out, the locking elements being however designed to allow the rotation in the winding direction.

6. A device as claimed in any one of claims 2 or 4, wherein the free wheel located in the kinematic chain connecting the driving-shaft to the propeller has a low friction torque and permits the free rotation of the propeller during free-flight.

7. A device as claimed in anyone of claims 3 or 4 wherein the driving-shaft drives one or more axes in rotation, each axis carrying a planetary gear freely which is mounted thereon and engages with an inside gear and driving a central gear pivoting on the driving-shaft and comprising means adapted to drive in rotation the propeller which is also pivoting on the driving-shaft.

8. A device as claimed in any one of claims 1, 2, 3, or 4 wherein the winding crank may be connected to a member which allows its extraction simultaneous to other winding cranks placed on other motors in the case of multiple-motor models.

* * * * *